US006502255B1

(12) United States Patent
Perkins et al.

(10) Patent No.: US 6,502,255 B1
(45) Date of Patent: Jan. 7, 2003

(54) MATTRESS SECURING DEVICE

(76) Inventors: Mark R. Perkins, 11807 Barnes Rd., Eaton Rapids, MI (US) 48827; Brandon J. Winkel, 3415 Oriole SW., Wyoming, MI (US) 49509

( * ) Notice: Subject to any disclaimer, the term of this patent is extended or adjusted under 35 U.S.C. 154(b) by 0 days.

(21) Appl. No.: 09/623,701

(22) PCT Filed: Mar. 4, 1999

(86) PCT No.: PCT/US99/04835

§ 371 (c)(1),
(2), (4) Date: Sep. 1, 2000

(87) PCT Pub. No.: WO99/44476

PCT Pub. Date: Sep. 10, 1999

(51) Int. Cl.[7] ..... A47C 19/00
(52) U.S. Cl. ..... 5/9.1; 5/8; 5/488; 5/658
(58) Field of Search ..... 5/8, 9.1, 488, 658

(56) References Cited

U.S. PATENT DOCUMENTS

| | | | | | |
|---|---|---|---|---|---|
| 679,656 | A | * | 7/1901 | Whiting | 5/658 |
| 2,445,030 | A | * | 7/1948 | Mandelbaum | 5/690 |
| 2,581,646 | A | * | 1/1952 | Froelich | 5/600 |
| 3,871,038 | A | | 3/1975 | Trivett | |
| 4,040,133 | A | | 8/1977 | Gilreath | |
| 4,109,328 | A | | 8/1978 | Mason | |
| 4,527,298 | A | | 7/1985 | Moulton | |
| 4,592,101 | A | | 6/1986 | Page | |
| 4,660,240 | A | * | 4/1987 | Hutton et al. | 5/669 |
| 4,703,529 | A | | 11/1987 | Mann | |
| 5,057,819 | A | | 10/1991 | Valenti | |
| 5,109,559 | A | | 5/1992 | West | |
| 5,150,487 | A | | 9/1992 | Hemphill | |
| 5,210,891 | A | | 5/1993 | Avital et al. | |
| 5,263,212 | A | | 11/1993 | Garcia | |
| 5,377,391 | A | | 1/1995 | Foster | |

* cited by examiner

*Primary Examiner*—Lynne H. Browne
*Assistant Examiner*—James M. Hewitt
(74) *Attorney, Agent, or Firm*—Price, Heneveld, Cooper, DeWitt & Litton

(57) ABSTRACT

A connector (10), for removably securing a mattress (18) to a mattress supporting bed frame (22), that is provided a length that is sufficient to allow one to pull the mattress (18) from a first position in which it is fully supported on the supporting frame (22), to a second position in which it is supported on an edge of the frame (22) and hangs out beyond the edge of the supporting frame (22). The connector (10) is sufficiently short to retain the mattress (18) in the second position and not allow the mattress (18) to fall off the supporting frame (22). The connector (10) allows a person placing sheets on the mattress (18) to pull the mattress (18) toward oneself into the second position and thereby more easily reach the far edge of the mattress (18) when placing sheets on it, and can then put the mattress (18) back into the first position when the sheets are in place.

28 Claims, 3 Drawing Sheets

MATTRESS SECURING DEVICE

BACKGROUND OF THE INVENTION

The present invention relates to beds. Bunk beds are common place in today's households and are used for variety of reasons including relatively simple construction of most bunk beds as well as the efficient use of a limited space. The traditional bunk bed consists of a frame that supports a lower bed and an upper bed. The frames typically are designed to support the upper bed several feet above the lower bed. While this configuration makes for the efficient use of a limited space in a room, it makes changing the sheets associated with the upper bed problematic by making it difficult to reach. The necessary height of the mattress above the floor as well as the necessity of the surrounding bed frame impedes access to the upper mattress and makes it difficult to reach the far edges of the mattress during linen and sheet changing operations.

Accordingly, it would be desirable to have available a system which improves access to the upper mattress without interfering with the placement of sheets or other coverings on the mattress.

SUMMARY OF THE INVENTION

The present invention comprises a bed, a kit for retrofitting a bed and a related method in which a mattress is tethered to the mattress support frame by a mattress-securing device. The present invention includes a mattress supporting frame, a mattress removably positioned on the supporting frame, and a connector secured to the frame and to the mattress. The connector is of a length that is sufficient to allow one to pull the mattress from a first position in which it is fully supported on the supporting frame, to a second position in which it is supported on an edge of the frame and hangs out beyond the edge of the supporting frame. The connector is sufficiently short to retain the mattress in the second position and not allow the mattress to fall off of the supporting frame. The connector allows a person placing sheets and covers on the mattress to pull the mattress toward himself or herself into the second position and thereby more easily reach the far edge of the mattress when placing sheets and covers on it, and can then push the mattress back into the first position when the sheets and covers are in place.

These and other advantages of the invention will be further understood and appreciated by those skilled in the art by reference to the following written specification, claims and appended drawings.

DETAILED DESCRIPTION OF THE PREFERRED EMBODIMENT

For purposes of the description herein, the terms "upper," "lower," "right," "left," "rear," "front," "vertical," "horizontal," and derivatives thereof shall relate to the invention as oriented such that the operator removes the mattress from the bed frame by standing in "front" of the invention and removing the mattress towards themselves. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
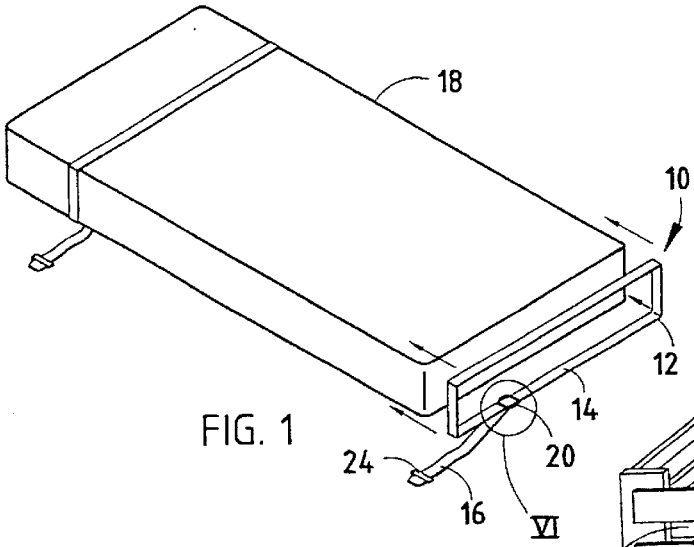
FIG. 1 is a perspective view of a mattress securing device positioned about a bed mattress.
Figure 2:
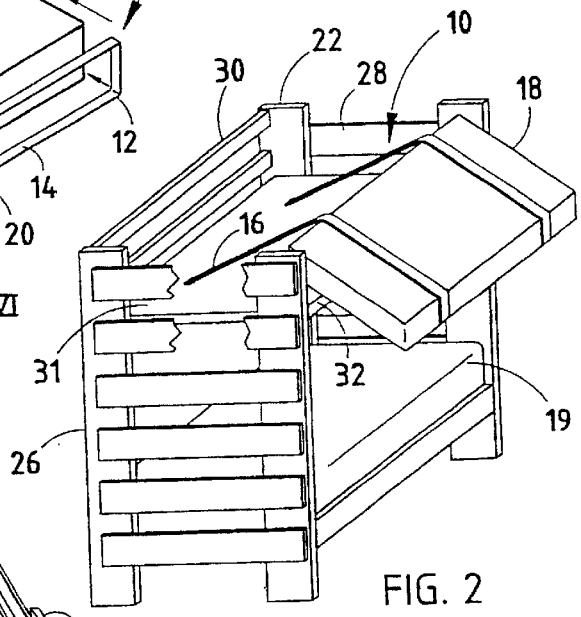
FIG. 2 is a perspective view of a mattress securing device supporting a mattress partially removed from a bunk bed frame.

The reference numeral 10 (FIGS. 1 and 2) generally designates a mattress-securing device embodying the present invention. In the illustrated example, the mattress securing device 10 includes a strap 12 configured to form a loop section 14 and leader portion 16 wherein the loop 14 is adapted to secure a bed mattress 18. Mattress securing device 10 further includes a buckle 20 slidably engaged with strap 12 and adapted to adjust the size of loop 14 formed by strap 12. Leader portion 16 of strap 12 is adapted to be attached to a bed frame 22 whereby mattress 18 may be partially removed from bed frame 22 thereby allowing easy access to mattress 18 for purpose of changing bed linens (not shown) and the like.

The illustrated straps 12 are constructed of nylon, or a material similar to that used in the manufacturing of automobile seatbelts, however, materials displaying similar properties and characteristics may be employed. It is preferable that at least two straps 12 are used to secure mattress 18 and that straps 12 be equally spaced along the length of mattress 18. However, any number of straps 12 may be employed including, a single strap if properly centered along the length of mattress 18.

Figure 6:
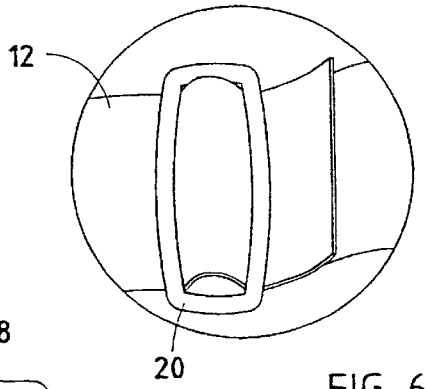
FIG. 6 is an enlarged fragmentary view of a buckle taken of the area VI, FIG. 5.
Figure 5:
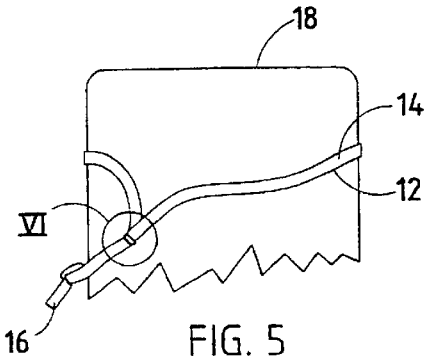
FIG. 5 is a fragmentary bottom plan view of the mattress securing device positioned about the bed mattress.

Strap 12 is slidably engaged with buckle 20 such that strap 12 forms loop section 14 and leader portion 16. The illustrated buckle (FIGS. 5 and 6) is adapted such that the size of loop 14 may be adjusted thereby allowing the operator to snuggly fit strap 12 about mattress 18.

Figure 7:
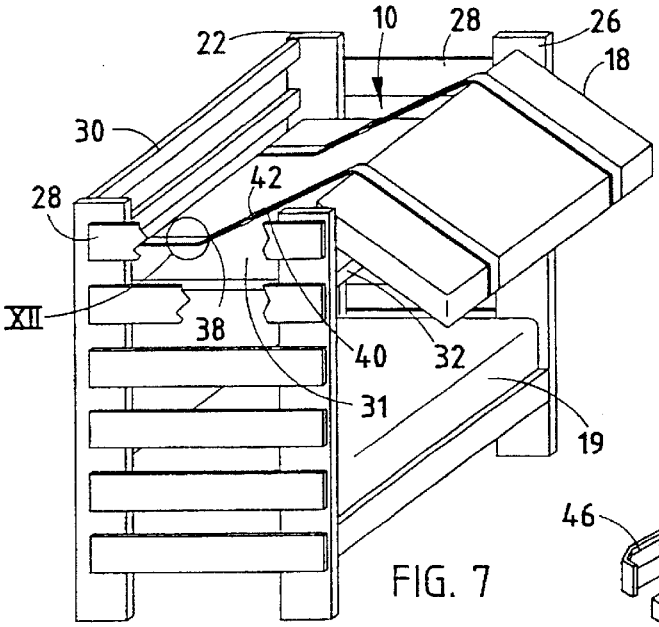
FIG. 7 is a perspective view of a first alternate embodiment of the mattress-securing device.

Bed frame 22 includes a plurality of legs 26, a plurality of bed rails 28, a plurality of back rail 30, a plurality of front rails 32 and mattress supports 31. Front rails 32 are preferably removable thereby allowing easy access to the associated mattress 18. Bed frame 22 is adapted to support upper mattress 18 and a lower mattress 19 (FIG. 7).

Figure 9:
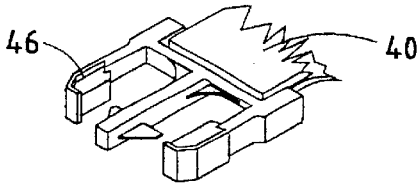
FIG. 9 is an enlarged, fragmentary view of a male portion of the quick connector.

Several adaptations and configurations of the mattress-securing device 10 are possible. In one particular embodiment of the present invention, leader portion 16 of strap 12 is provided with a mounting bracket 24 (FIGS. 3 and 4) that is adapted to mount to bed frame 22. Mounting bracket 24 (FIG. 9) is provided with an aperture 34 located therein and adapted to receive a plurality of mechanical fasteners 36 there through such as wood screws, lags, nuts and bolts, and the like. Mounting bracket 24 is attached to mattress support 31 (FIGS. 2 and 3), however, mounting bracket 24 may be secured to any suitable component of bed frame 22.

Figure 3:
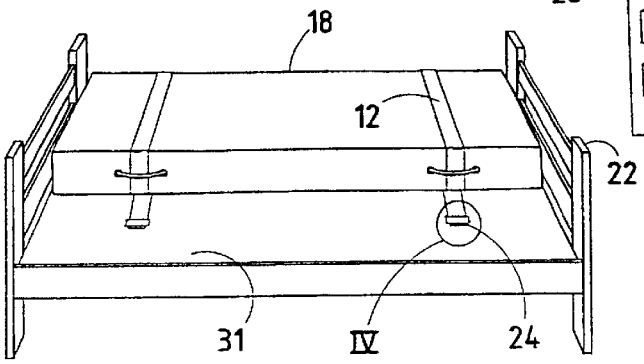
FIG. 3 is a front isometric view of the mattress-securing device.
Figure 4:
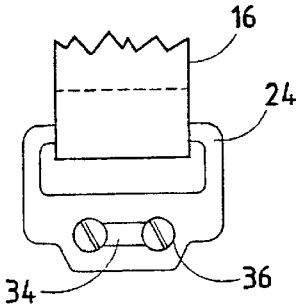
FIG. 4 is an enlarged, fragmentary view of a mounting bracket taken of the area IV, FIG. 3.
Figure 8:
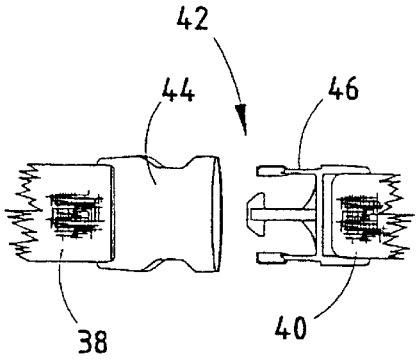
FIG. 8 is an enlarged, fragmentary view of a quick connector.

In another embodiment of the present invention, leader portion 16 (FIG. 7) of strap 12 is provided with a first securing section 38, a second securing section 40, and a quick connector 42 located therebetween and operably connecting first securing section 38 to second securing section 40. First securing section 38 may be adapted to attach directly to a component of bed frame 22, or may be provided with bracket 24 (FIGS. 3 and 4). Quick connector 42 (FIG. 8) is provided a female portion 44 and a male portion 46 adapted to be matably received within female portion 44 such that male portion 46 may be easily released from connection with female portion 44 thereby allowing the complete removal of mattress 18 from bed frame 22. Male portion 46 (FIG. 9) of quick connector 42 is adapted such that the operable length of second securing section 40 of leader portion 16 may be adjusted thereby allowing the operator to adjust the distance mattress 18 may be removed from bed frame 22.

Figure 10:
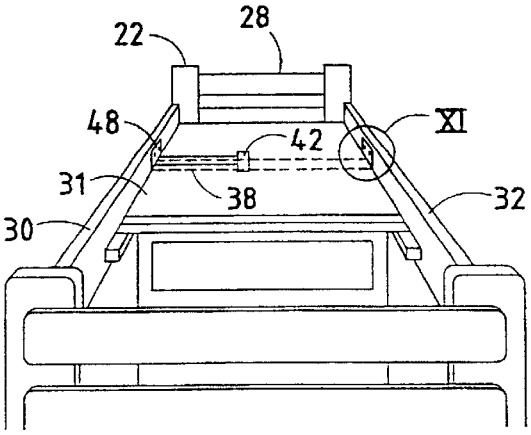
FIG. 10 is a left end isometric view of the mattress securing device attached to the bunk bed frame.
Figure 11:
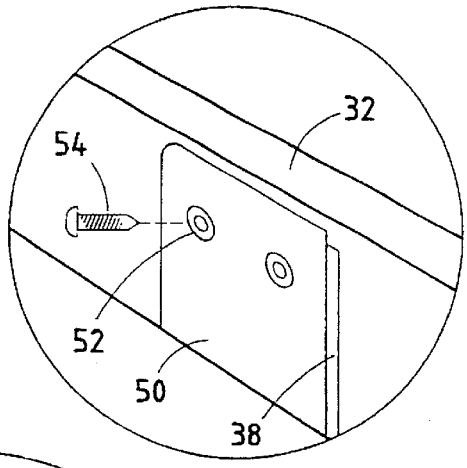
FIG. 11 is an enlarged, fragmentary view of a mounting bracket taken of the area XI, FIG. 10.

In yet another embodiment of the present invention first securing section 38 (FIG. 10) of leader portion 16 is attached to back rail 30 of bed frame 22 by way of a first mounting bracket 48 adapted to attach to rear rail 48 as described in further detail below. First securing section 38 of leader portion 16 extends beyond mounting bracket 48 and extends beneath mattress 18 and mattress support 31 to front rail 32 where first securing section 38 of leader portion 16 is connected to front rail 32 by way of a second mounting bracket 50 (FIG. 11). First mounting bracket 48 and second mounting bracket 50 are each provided with a plurality of mounting apertures 52 adapted to receive mechanical fasteners 54 therein, such as wood screws, lags, nuts and bolts, and the like. By extending first securing section 38 of leader portion 16 below mattress 18 and mattress support 31 and attaching first securing section to rear rail 30 and to front rail 32 by way of mounting plate 48 and mounting plate 50, respectively, mattress 18 and mattress support 31 are prevented from falling downward onto a lower bunk if mattress support 31 and/or mattress 18 are shifted within bed frame 22.

Figure 12:
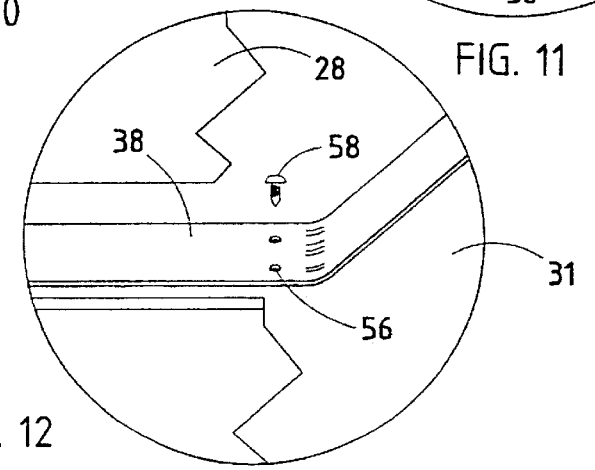
FIG. 12 is an enlarged, fragmentary view of a grommet section of the mattress-securing device taken of the area XII, FIG. 7.

In still yet another embodiment of the present invention, first securing section 38 (FIGS. 7 and 12) is provided with a pair of grommets 56 located therein and adapted to receive mechanical fasteners 58 such as wood screws or bolts therein. The grommets 56 are located within first securing section 38 of leader portion 16 such that mechanical fasteners 58 are mounted within mattress support 31 approximately ⅓ of the distance between rear rail 30 and front rail 32. Fastening first securing section 38 of leader portion 16 to mattress support 31 acts to reduce the moment arm of mattress 18 acting upon bed frame 22 by way of leader portion 16 thereby decreasing the chance of having the weight of the mattress 18 tip bed frame 22 forward when mattress 18 is partially removed from within bed frame 22 during the linen changing process.

Figure 13:
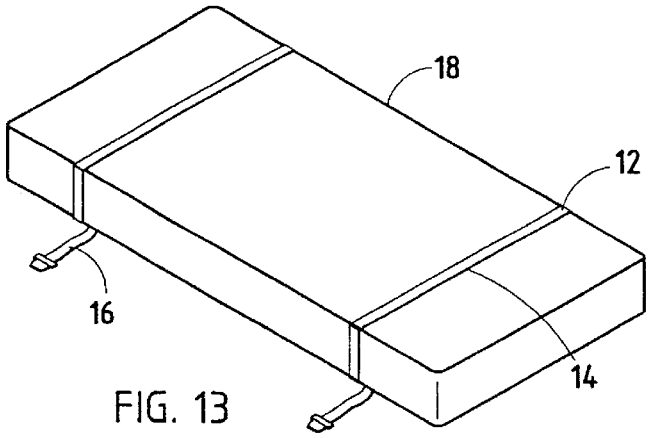
FIG. 13 is a perspective view of the mattress securing device fitted about the mattress.
Figure 14:
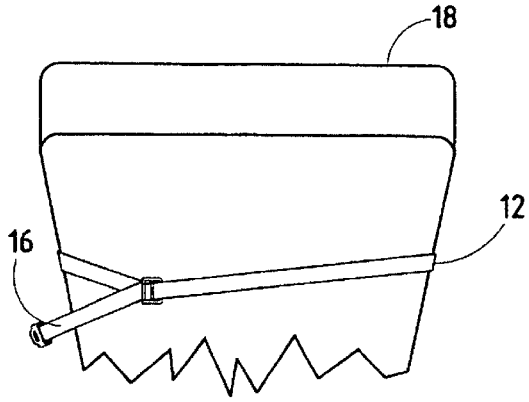
FIG. 14 is a bottom isometric view of the mattress securing device fitted about the mattress.
Figure 15:
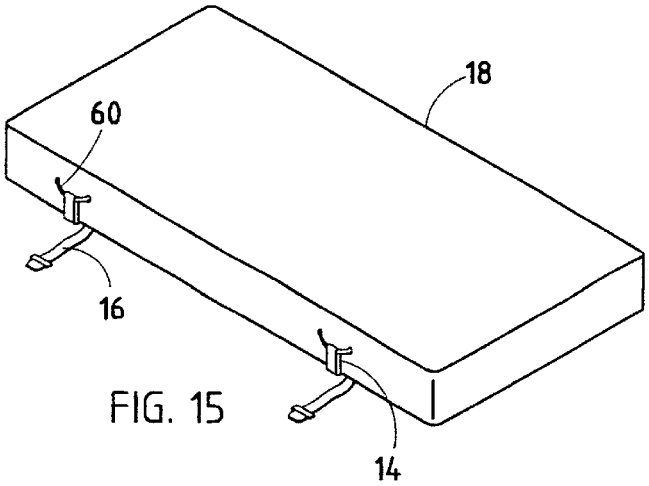
FIG. 15 is a perspective view of the mattress securing device laced through the mattress handles associated with the mattress.
Figure 16:
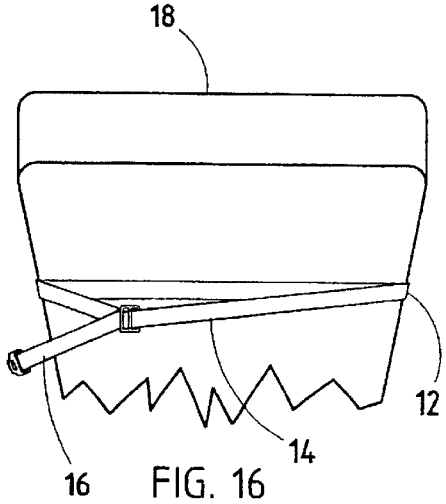
FIG. 16 is a bottom isometric view of the mattress securing device laced throughout the mattress handles associated with the mattress.

Loop 14 (FIGS. 12–15) is adapted to mattress 18 in at least two configurations. In the first configuration (FIGS. 12 and 13) loop 14 of strap 12 is positioned about the circumference of the mattress, thereby making mattress-securing device 10 adaptable to any mattress. In an alternate configuration, loop 14 (FIGS. 14 and 15) is threaded through handles 60 of mattress 18 thereby eliminating the need for the loop 14 to pass above mattress 18. It should be noted that the alternative configuration of loop 14 should only be employed with mattress 18 having handles 60 sufficiently secured to mattress 18.

The mattress securing device 10 as described above provides an uncomplicated, easy to assemble apparatus for securing a mattress 18 to a bed frame 22 wherein the mattress 18 is partially removable from the bed frame 22 thereby allowing easy access to mattress 18 for the purpose of changing bed linens and the like. In addition, the mattress-securing device 10 allows a single person to adjust mattress 18 and change the linens associated with the upper mattress 18 without aid of a second person.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A bed assembly, comprising:

a mattress supporting frame;

a mattress removably positioned on said supporting frame;

a mounting bracket attached to said frame; and a connector including at least one strap having a first section, a second section, and at least one buckle, said first section of said strap configured to form a loop section and said second section of said strap configured to form a leader portion, wherein said loop section secures said mattress and, said leader portion includes a first securing section, a second securing section and a quick release connector wherein said first securing section is connected to said mounting bracket and said quick connector operably connects said first securing section to said second securing section, said buckle slidably engaged with said strap and adapted to allow the person to adjust the size of said loop formed by said strap, said leader portion of said strap is attached to said frame;

said connector being a length which is sufficient to allow one to pull said mattress from a first position in which said mattress is fully supported on said supporting frame, to a second position in which said mattress is supported on an edge of said frame and hangs out beyond said edge of said supporting frame, said connector being sufficiently short to retain said mattress in said second position and not allow said mattress to fall off of said supporting frame;

whereby a person placing sheets and covers on said mattress can pull said mattress toward himself or herself into said second position and thereby more easily reach the far edge of said mattress when placing sheets and covers on said mattress, and can then push said mattress back into said first position when the sheets and covers are in place, and whereby said quick connector may be disconnected allowing complete removal of said mattress from said frame.

2. The bed assembly described in claim 1, wherein:

said quick connector is adapted to adjust a length of said leader portion, whereby the distance said mattress may be removed from said bed is adjustable.

3. The bed assembly described in claim 2, wherein:

said frame includes a mattress support extending below said mattress; and said mounting bracket is connected to said frame and said first securing section of said strap extends across an underside of said mattress and said mattress support and is fixedly attached to said frame at a position substantially juxtaposed across said mattress from said mounting bracket, whereby said mattress and said mattress support are prevented from falling downward.

4. The bed assembly described in claim 3, further including:

a second mounting bracket connected to said leader portion of said strap, said bracket attached to said frame at a position substantially juxtaposed across said mattress from said first mounting bracket.

5. The bed assembly described in claim 4, wherein:

said second securing section is fixedly attached to said mattress support.

6. The bed assembly described in claim 5, wherein:

said mattress support includes at least two pieces.

7. The bed assembly described in claim 6, wherein:

said at least one strap includes a first strap and a second strap.

8. The bed assembly described in claim 7, wherein:

said loop section of said first strap and said second strap are wrapped about the mattress.

9. The bed assembly described in claim 6, wherein:

said mattress includes at least one mattress handle, and said loop section of said first strap and said second strap are laced through said mattress handles such that said strap does not extend above said mattress.

10. A bed assembly, comprising:

a mattress supporting frame;

a mattress removably positioned on said supporting frame, and including at least one mattress handle; and a connector secured to said frame and laced through said mattress handle such that said connector does not extend above said mattress;

said connector being a length which is sufficient to allow one to pull said mattress from a first position in which said mattress is fully supported on said supporting frame, to a second position in which said mattress is supported on an edge of said frame and hangs out beyond said edge of said supporting frame, said connector being sufficiently short to retain said mattress in said second position and not allow said mattress to fall off of said supporting frame;

whereby a person placing sheets and covers on said mattress can pull said mattress toward himself or herself into said second position and thereby more easily reach the far edge of said mattress when placing sheets and covers on said mattress, and can then push said mattress back into said first position when the sheets and covers are in place.

11. A kit for securing a mattress to a bed frame, comprising:

at least one strap configured to form a loop section adapted to secure a bed mattress and a leader portion having a first securing section, a second securing section and a quick release connector wherein said first securing section is connected to a mounting bracket adapted to connect to a bed frame and said quick connector operably connects said first securing section to said second securing section whereby said quick connector may be disconnected thereby allowing complete removal of the mattress from the bed frame; and at least one buckle slidably engaged with said strap and adapted to adjust the size of said loop formed by said strap;

whereby the mattress is adapted to be partially removed from the bed frame thereby providing easy access to the mattress for the purpose of changing bed linens.

12. The kit for securing a mattress to a bed frame described in claim 11, wherein:

said quick connector is adapted to adjust a length of the leader portion, whereby the distance the mattress may be removed from the bed frame may be adjusted.

13. The kit for securing a mattress to a bed frame described in claim 12, wherein:

said mounting bracket is adapted to connect to a rail of the bed frame and said first securing section of said strap is provided a sufficient length to extend across an underside of the mattress and any bed component supporting the mattress and is adapted to fixedly attach to the bed frame at a position substantially juxtaposed across the mattress from the mounting bracket, whereby the mattress and any bed component supporting the mattress may be prevented from falling downward.

14. The kit for securing a mattress to a bed frame described in claim 13, further including:

a second mounting bracket adapted to connect to said leader portion of said strap, said second mounting bracket adapted to attach to the bed frame at a position substantially juxtaposed across the mattress from the first mounting bracket.

15. The kit for securing a mattress to a bed frame described in claim 14, wherein:

said second securing section is adapted to fixedly attached to the bed components supporting the mattress.

16. The kit for securing a mattress to a bed frame described in claim 15, further including:

a mattress support for supporting the mattress within the bed frame.

17. The kit for securing a mattress to a bed frame described in claim 16, wherein:

said mattress support includes at least two pieces.

18. The kit for securing a mattress to a bed frame described in claim 17, wherein:

said at least one strap includes a first strap and a second strap.

19. The kit for securing a mattress to a bed frame described in claim 18, wherein:

said loop section of said first strap and said second strap are wrapped about the mattress.

20. The kit for securing a mattress to a bed frame described in claim 18, wherein:

said mattress is provided with at least one mattress handle, and said loop section of said first strap and said second strap are laced through a plurality of mattress handles associated with the mattress.

21. A method for securing a mattress to a bed frame, comprising:

providing at least one strap configured to form a loop section adapted to secure a bed mattress and a leader portion having a first securing section, a second securing section and a quick release connector wherein the first securing section is connected to a mounting bracket and the quick connector operably connects the first securing section to the second securing section whereby the quick connector may be disconnected allowing removal of the bed from the bed frame;

providing at least one buckle slidably engaged with the strap and adapted to adjust the size of the loop formed by the strap;

adjusting the size of the loop of the strap by way of the buckle such that the mattress is snuggly held by the loop;

providing a mounting bracket connected to the second securing section of the strap; and attaching the mounting bracket to the bed frame, whereby the mattress may be partially removed from the bed frame thereby providing easy access to the mattress for the purpose of changing bed linens.

22. The method as described in claim 21, wherein:

said step of providing the strap includes providing the quick connector such that the quick connector is adapted to adjust a length of the leader portion; and further including:

adjusting the length of the leader portion thereby adjusting the distance the mattress may be removed from the bed.

23. The method as described in claim 22, wherein:

said step of attaching the mounting bracket includes attaching the mounting bracket to a rail of the bed frame;

said step of providing the strap includes extending the first securing section of the strap across an underside of the mattress and any bed component supporting the mattress; and further including:

fixedly attaching the first securing section of the strap to the bed frame at a position substantially juxtaposed across the mattress from the mounting bracket, whereby the mattress and any bed component supporting the mattress are prevented from falling downward.

24. The method as described in claim 23, further including:

providing a second mounting bracket attached to the leader portion of the strap; and attaching the bracket to the bed frame at a position substantially juxtaposed across the mattress from the first mounting bracket.

25. The method as described in claim 24, further including:

fixedly attaching the first securing section of the leader portion to the bed frame.

26. The method as described in claim 25, wherein:

said step of providing at least one strap includes providing a first strap and a second strap.

27. The method as described in claim 26, wherein:

said step of adjusting the loop section of said first strap and said second strap includes wrapping the loop section of the first strap and the second strap about the mattress.

28. The method as described in claim 27, wherein:

said step of adjusting the loop section of said first strap and said second strap includes lacing the loop section of the first strap and the second strap through a plurality of mattress handles attached to the mattress.

* * * * *